US005850893A

United States Patent [19]

Hede et al.

[11] Patent Number: 5,850,893

[45] Date of Patent: Dec. 22, 1998

[54] SELF-LOCKING DESCENDER FOR A ROPE WITH AN OPERATING LEVER

[75] Inventors: Jean Marc Hede, Le Touvet; Paul Petzl, Barraux, both of France

[73] Assignee: Zedel, Crolles, France

[21] Appl. No.: 726,477

[22] Filed: Oct. 7, 1996

[30] Foreign Application Priority Data

Nov. 28, 1995 [FR] France ..... 95 14375

[51] Int. Cl.[6] ..... A62B 1/20

[52] U.S. Cl. ..... 182/193; 182/5; 188/65.5

[58] Field of Search ..... 182/5, 6, 7, 191, 182/192, 193; 188/65.2, 65.3, 65.4, 65.5

[56] References Cited

U.S. PATENT DOCUMENTS

| | | | |
|---|---|---|---|
| 209,137 | 10/1878 | Rotschka etal. | 182/193 |
| 1,229,394 | 6/1917 | Abramson | 182/193 |
| 4,399,889 | 8/1983 | Todd | 182/193 X |
| 4,576,248 | 3/1986 | Marom | 182/5 |
| 4,580,658 | 4/1986 | Brda | 182/193 X |
| 4,596,314 | 6/1986 | Rogelja | 182/5 X |
| 5,054,577 | 10/1991 | Petzl et al. | 182/193 X |
| 5,597,052 | 1/1997 | Rogelja | 182/193 X |

FOREIGN PATENT DOCUMENTS

| | | |
|---|---|---|
| A-1-0398819 | 11/1990 | European Pat. Off. . |
| A-2451752 | 10/1980 | France . |
| A-2554102 | 5/1985 | France . |
| WO-A-90-10476 | 9/1990 | WIPO . |

*Primary Examiner*—Daniel P. Stodola
*Assistant Examiner*—Richard M. Smith
*Attorney, Agent, or Firm*—Oliff & Berridge, PLC

[57] ABSTRACT

A self-locking descender for a rope comprises a pulley in the form of a rotary cam designed to press the rope against a braking surface of a stud. The pulley is mounted on an operating plate associated with an operating handle. To reduce the unlocking force on the operating lever, a part of the friction forces is taken up by a load-shedding pin situated facing the circular sector of the cam. The rope passes via the load-shedding pin and comes partially into contact with the pulley.

3 Claims, 4 Drawing Sheets

SELF-LOCKING DESCENDER FOR A ROPE WITH AN OPERATING LEVER

BACKGROUND OF THE INVENTION

The invention relates to a self-locking descender for a rope comprising:

- a support flange of a stud, and of a pulley shaped as a rotary cam separated from the stud by a gap for passage of the rope,
- an operating plate securedly affixed to the pulley and mounted with limited pivoting around a spindle in a plane appreciably parallel to the flange,
- an operating handle designed to move the operating plate in the loaded state of the descender between the raised locking position and an unlocking position,
- and a braking surface arranged on the stud on the same side as the gap for passage of the rope, the rope being pressed against the braking surface by the action of a boss of the pulley, which is driven in rotation by the friction effect of the rope in the locking direction.

A known descender of the kind referred to is described in the document FR-A-2,451,752. The peripheral length of the cam coming into engagement with the rope extends in the region of 180° and generates high friction forces on the pulley in the locking direction. The manual unlocking force required to release the rope is great.

Several solutions exist to reduce this unlocking force. The radius of the pulley can be decreased so as to reduce the torque applied by the friction of the rope on the pulley. This solution has limits, since the pulley has to be adapted to the diameter of the rope.

Another solution consists in lengthening the operating handle, which is detrimental to the overall dimensions and to the angular range of movement of the pulley.

It is also possible to reduce the actuating force required for unlocking by associating the operating lever to a gearing-down mechanism, which however complicates manufacturing of the descender and increases its cost.

The form of the fixed stud and of the circular sector of the cam could be modified to reduce the winding angle of the rope in the apparatus. The friction effect of the rope would in this case be insufficient to perform efficient locking should the operating lever be released.

SUMMARY OF THE INVENTION

The object of the invention is to achieve a self-locking descender for a rope, having an efficient locking effect and requiring a reduced actuating force to perform unlocking.

The descender according to the invention is characterized in that the flange is equipped with a load-shedding device arranged facing the lower sector of the pulley opposite the gap for passage of the rope, the rope cooperating with the load-shedding device so as to transfer a part of the friction forces exerted by the rope on the pulley in the direction of the flange, to reduce the actuating force of the operating lever to the unlocking position.

According to a preferred embodiment, the load-shedding device is formed by a fixed pin perpendicular to the flange and extending parallel to the pivoting spindle of the pulley.

The pin is separated from the lower sector of the pulley by a predetermined distance, designed to reduce the winding angle of the rope around the pulley.

According to one feature of the invention, the load-shedding device is associated with a selector designed to adjust the winding angle of the rope according to the weight of the user.

BRIEF DESCRIPTION OF THE DRAWINGS

Other advantages and features will become more clearly apparent from the following description of an embodiment of the invention, given as a nonrestrictive example only, and represented in the accompanying drawings, in which.

DETAILED DESCRIPTION OF THE PREFERRED EMBODIMENT

Figure 2:
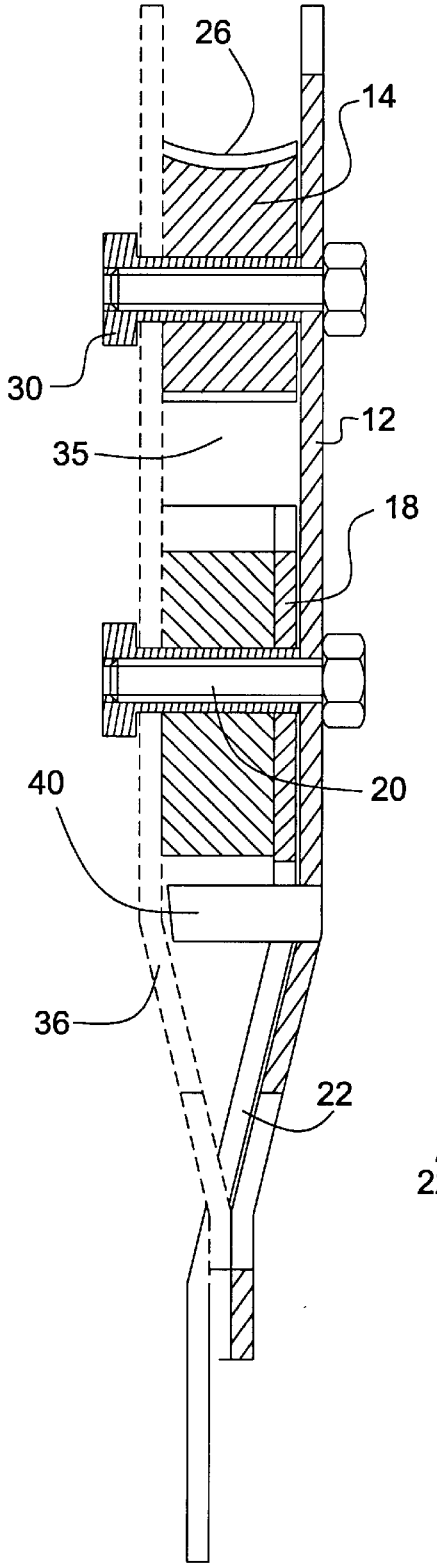
FIG. 2 is a cross-sectional view along the line 2—2 of FIG. 1.
Figure 1:
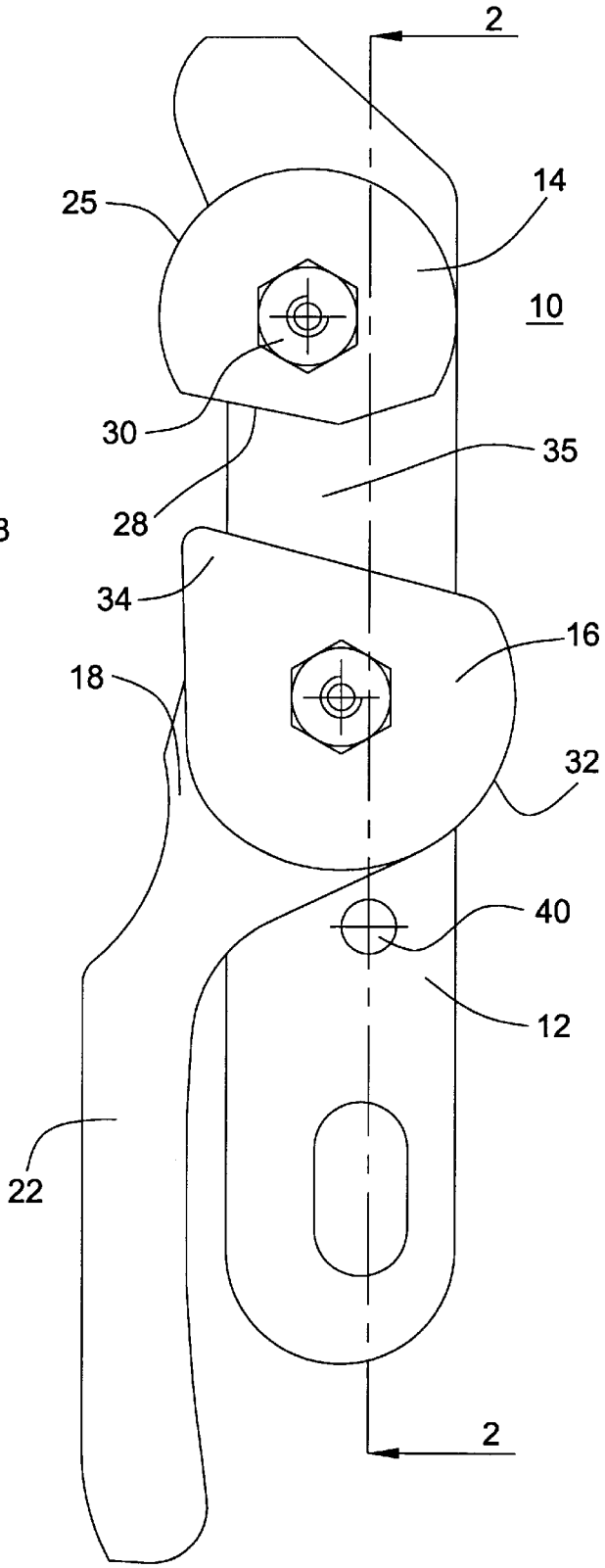
FIG. 1 is an elevational view of the self-locking descender according to the invention, the retractable upper flange not being represented.

In FIGS. 1 to 5, a self-locking descender 10 for a rope comprises a support flange 12 supporting a fixed stud 14 and a pulley 16 shaped as a rotary cam. The pulley 16 is supported by an operating plate 18 mounted with limited pivoting around a spindle 20 in a plane appreciably parallel to the flange 12.

An operating handle 22 is associated with the operating plate 18 to perform manual unlocking of the rope 24. The fixed stud 14 is provided with a circular upper sector 25 having a guiding groove 26 of the rope 24, and a braking surface 28 situated facing the pulley 16.

The fixed stud 14 is mounted fixed on the flange 12 by means of a fixing part 30, and is immobilised in rotation. The operating plate 18 is separated from the flange 12 by a small axial clearance allowing a pivoting movement between a locked position and an unlocked position of the rope 24.

Figure 4:
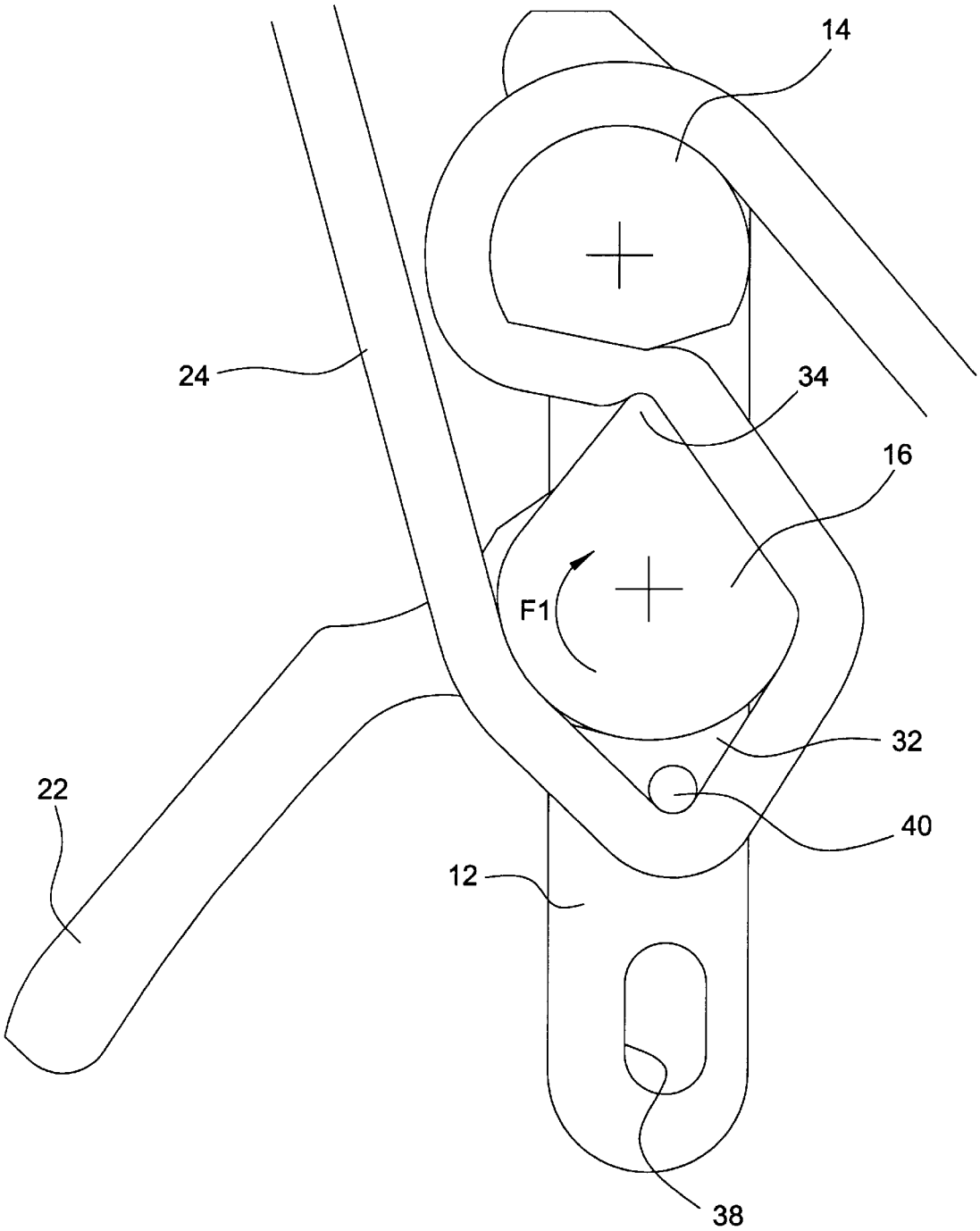
FIGS. 4 and 5 are identical views to FIG. 3, the descender being represented in the loaded state, respectively in the locking position and in the unlocking position of the operating lever.

The pulley 16 comprises a circular lower sector 32 provided with a groove for winding the rope, and a boss 34 designed to jam the rope 24 against the braking surface 28 of the stud 14 when the operating handle 22 is in the raised position (FIG. 4).

The pulley 16 is separated from the stud 14 by a gap 35 for passage of the intermediate strand of the rope 24, the width of the gap 35 being decreasing when the lever 22 moves from the lowered position (FIG. 3) to the raised position (FIG. 4).

A second retractable flange 36 (represented in broken lines in FIG. 2) is arranged opposite the flange 12 extending parallel to the latter, and serves the purpose of holding the rope 24 captive in the gap 35 after the latter has been wound in an S on the pulley 16 and stud 14. An oblong hole 38 is situated in the lower part of the flange 12 for passage of a snap-hook.

According to the invention, the flange 12 comprises a load-shedding device 40 over which the rope 24 passes, said load-shedding device being arranged facing the lower sector 32 of the pulley 16 to take up a part of the friction force exerted by the rope 24 in the loaded state of the self-locking descender 10. The load-shedding device 40 is formed for example by a pin or a fixed spindle perpendicular to the flange 12 and extending parallel to the pivoting spindle 20 of the pulley 16. The radial separating distance of the pin 40 and sector 32, and the positioning of the pin on the flange 12, are chosen to modify the winding angle of the rope 24 on the sector 32 of the pulley 16. The pulley 16 is arranged between the pin 40 and the gap 35 for passage of the rope 24.

Figure 3:
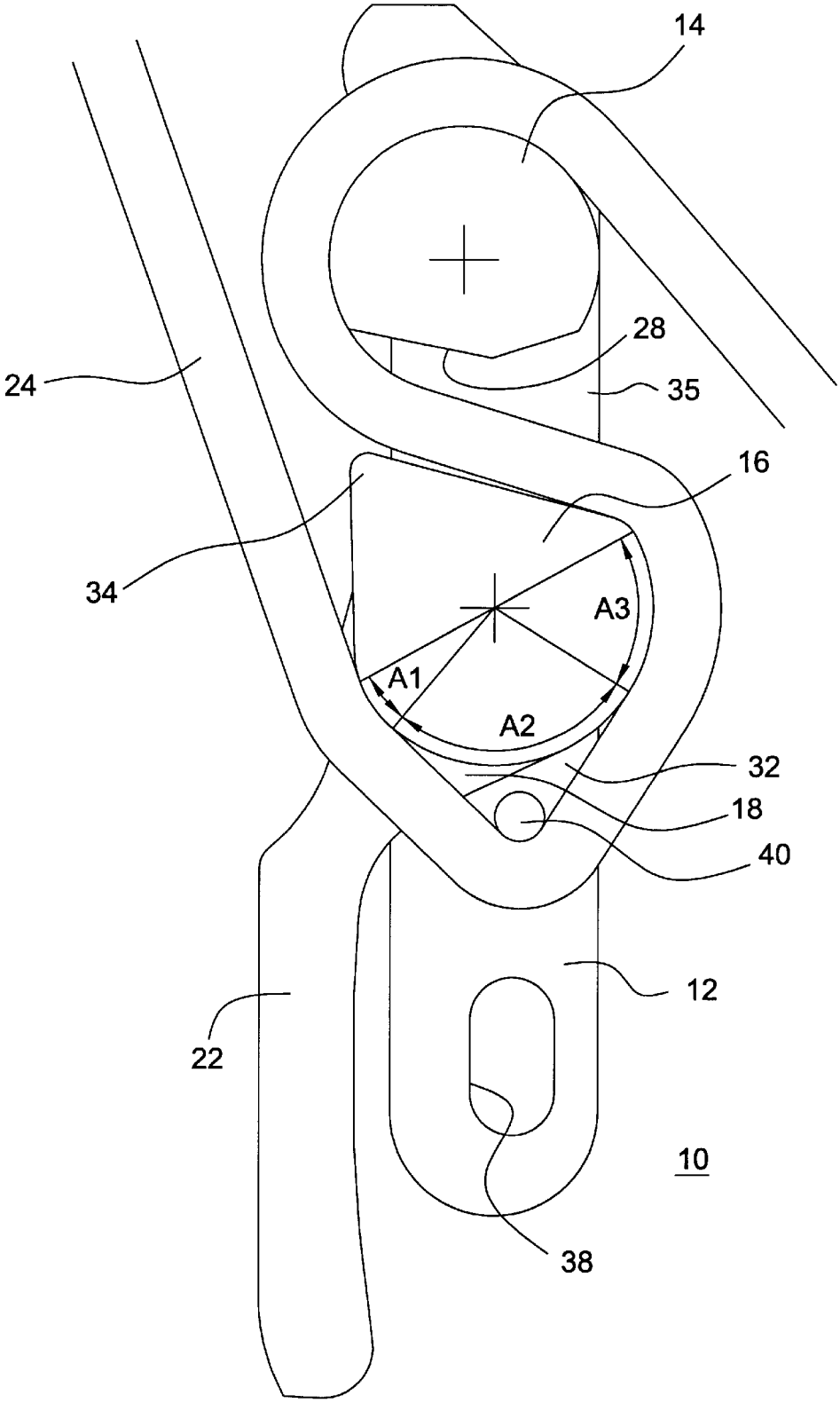
FIG. 3 shows an identical view of the descender of FIG. 1, after the rope has been inserted in the non-loaded state.

Operation of the self-locking descender 10 according to the invention is as follows:

After the rope 24 has been wound in an S around the assembly formed by the pulley 16, load-shedding device 40, and stud 14, the descender 10 is in the non-loaded state and in the rest position of the operating lever 22 (FIG. 3).

After the retractable flange 36 has been closed, the user can let the rope 24 drop to begin the descending movement. In the loaded state of the descender 10 and after the operating handle 22 has, been released, the pulley 16 in the form of a cam is driven in clockwise rotation (arrow F1 FIG. 4) around the spindle 20, and the boss 34 jams the rope 24 against the braking surface 28 of the stud 14. The rotational driving torque of the pulley 16 results from the friction effect of the rope, and the user remains secured on the rope in complete safety. The operating lever 22 is then in the raised locking position.

Figure 5:
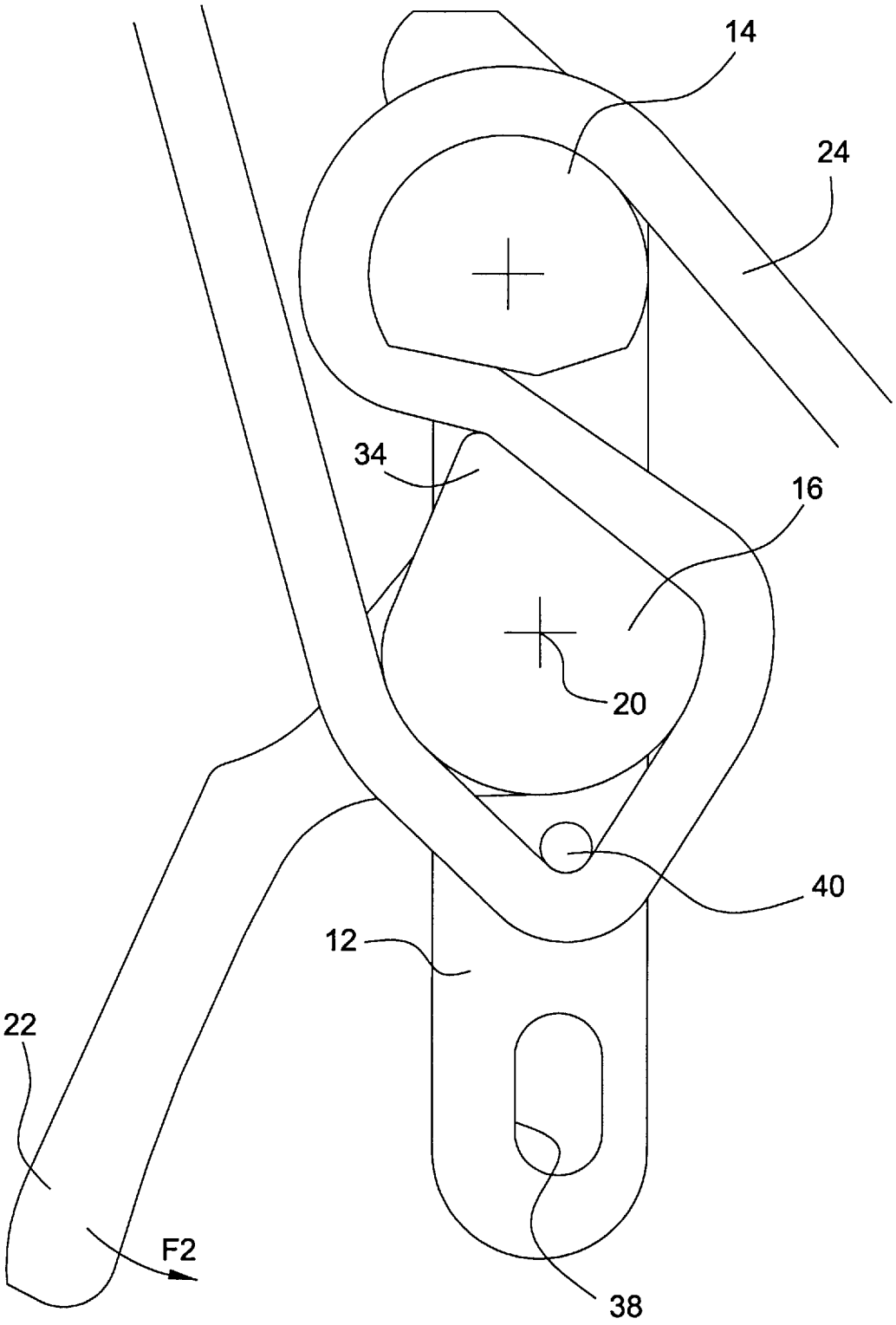

With reference to FIG. 5, lowering of the operating lever 22 in the direction of the arrow F2 brings about counter-clockwise rotation of the pulley 16 and progressive unlocking of the rope by increasing the width of the gap 35. The descending movement is then authorized, and the speed of descent can be adjusted by lowering the operating lever 22 more or less.

In the loaded state of the descender, movement of the operating lever 22 from the raised locking position (FIG. 4) to the intermediate unlocking position (FIG. 5) requires a small actuating force on the handle 22 to overcome the friction forces on the rope 24. This reduction of the unlocking force results from the transfer of a part of the friction forces onto the loadshedding device 40 securedly united to the fixed flange 12. The winding angle of the rope 24 on the pulley 16 corresponds to the sum of the elementary sectors A1 and A3, whereas the intermediate sector A2 of the pulley 16 does not come into contact with the rope 24 (FIG. 3).

The same global friction is preserved at the level of the descender, and the locking effect of the rope 24 in the raised position of the operating lever 22 remains effective in spite of the presence of the load-shedding pin 40. This global friction is proportional to the sum of the elementary sectors A1, A2, and A3, but the partial friction on the pulley 16 is lower than the global friction, which makes operation of the operating lever 22 to the intermediate unlocking position easy in the loaded state of the descender 10.

According to an alternative embodiment (not represented), the positioning of the load-shedding device 40 on the flange 12 can be adjusted to choose the winding angle of the rope 24 on the pulley 16 according to the weight of the user. The load-shedding device 40 is in this case advantageously associated with an adjustment selector accessible by the user to determine the hardness of manual actuation of the operating lever 22.

We claim:

1. A self-locking descender for a rope comprising:

a support flange of a stud, and of a pulley shaped as a rotary cam, said pulley being separated from the stud by a gap for passage of the rope;

an operating plate securedly affixed to the pulley and mounted with limited pivoting around a spindle in a plane appreciably parallel to the flange;

an operating handle designed to move the operating plate in a loaded state of the descender between a raised locking position and an unlocking position;

a braking surface arranged on the stud on the same side as the gap for passage of the rope, the rope being pressed against the braking surface by the action of a boss of the pulley, which is driven in rotation by the friction effect of the rope in a locking direction; and a load-shedding device fastened to the support flange, the load-shedding device facing a lower sector of the pulley opposite the gap, the rope passing over the load-shedding device so as to transfer a part of the friction forces exerted by the rope on the pulley in the direction of the flange, and to reduce the actuating force of manipulating the operating handle to the unlocking position, whereby the rope contacts first and second elementary sectors of the lower sector of the pulley and does not contact an intermediate sector of the lower sector of the pulley to reduce a winding angle of the rope on the pulley.

2. The self-locking descender according to claim 1, wherein the load-shedding device is formed by a fixed pin perpendicular to the flange and extending parallel to the pivoting spindle of the pulley.

3. The self-locking descender according to claim 2, wherein the pin is separated from the lower sector of the pulley by a predetermined distance, designed to reduce a winding angle of the rope around the pulley.

* * * * *